United States Patent [19]

Hachiga et al.

[11] 4,378,779

[45] Apr. 5, 1983

[54] IGNITION SYSTEM FOR INTERNAL COMBUSTION ENGINES

[75] Inventors: Takasi Hachiga, Kariya; Yasuo Taguchi, Yokohama, both of Japan

[73] Assignees: Nippondenso Co., Ltd., Kariya; Toshiba Corporation, Kawasaki, both of Japan

[21] Appl. No.: 173,895

[22] Filed: Jul. 28, 1980

[30] Foreign Application Priority Data

Jul. 27, 1979 [JP] Japan ..... 54-96509

[51] Int. Cl.[3] ..... F02P 1/00

[52] U.S. Cl. ..... 123/644; 123/621; 123/622; 123/640

[58] Field of Search ..... 123/640, 649, 621, 622, 123/644

[56] References Cited

U.S. PATENT DOCUMENTS

| | | | |
|---|---|---|---|
| 3,605,713 | 9/1971 | Le Masters | 123/644 |
| 3,910,247 | 10/1975 | Hartig | 123/621 |
| 4,167,928 | 9/1979 | Pagel | 123/649 |
| 4,245,594 | 1/1981 | Morino et al. | 123/621 |
| 4,285,323 | 8/1981 | Sugiura | 123/644 |

*Primary Examiner*—Ronald B. Cox

*Attorney, Agent, or Firm*—Cushman, Darby & Cushman

[57] ABSTRACT

An ignition system for an internal combustion engine includes two power transistors respectively connected to opposite ends of the primary winding of an ignition coil to interrupt the primary currents which flow from a power source through the mid-tap of the primary winding. The two power transistors have emitters connected in common and a resistor is connected to the junction of this common connection to detect respective primary currents with the single resistor. A single current control circuit is provided to control the two power transistors in response to the detected respective primary currents.

4 Claims, 3 Drawing Figures

IGNITION SYSTEM FOR INTERNAL COMBUSTION ENGINES

BACKGROUND OF THE INVENTION

The present invention relates to an ignition system for internal combustion engines which includes a plurality of power transistors for interrupting the primary current in an ignition coil.

Known ignition systems of the above type are so designed that the primary current flowing to each power transistor is detected by the associated primary current detecting resistor so that the power transistors are controlled independently of each other by the associated current control circuits and the ignition coil primary current flowing to the power transistors is feedback controlled.

The known system of the above type is disadvantageous in that the primary current detecting resistors and the current control circuits must be the same in number as the power transistors with the resulting complication of the circuitry and increase in the cost, and moreover, the variations in primary current controlling characteristics among the primary current detecting resistors as well as the current control circuits result in the variations in primary current control among the respective power transistors.

SUMMARY OF THE INVENTION

With a view to overcoming the foregoing deficiencies in the prior art, it is the object of the present invention to provide an improved ignition system for internal combustion engines in which the emitters of power transistors are connected to each other and a current detecting resistor is connected to the interconnected emitters, whereby the current detecting resistor and a current control circuit are used in common with the plurality of power transistors, thus simplifying the circuit construction, reducing the cost, and reducing the variations in primary current control due to the differences among the power transistors.

DESCRIPTION OF THE PREFERRED EMBODIMENTS

The present invention will now be described in greater detail with reference to the illustrated embodiments.

Figure 1:
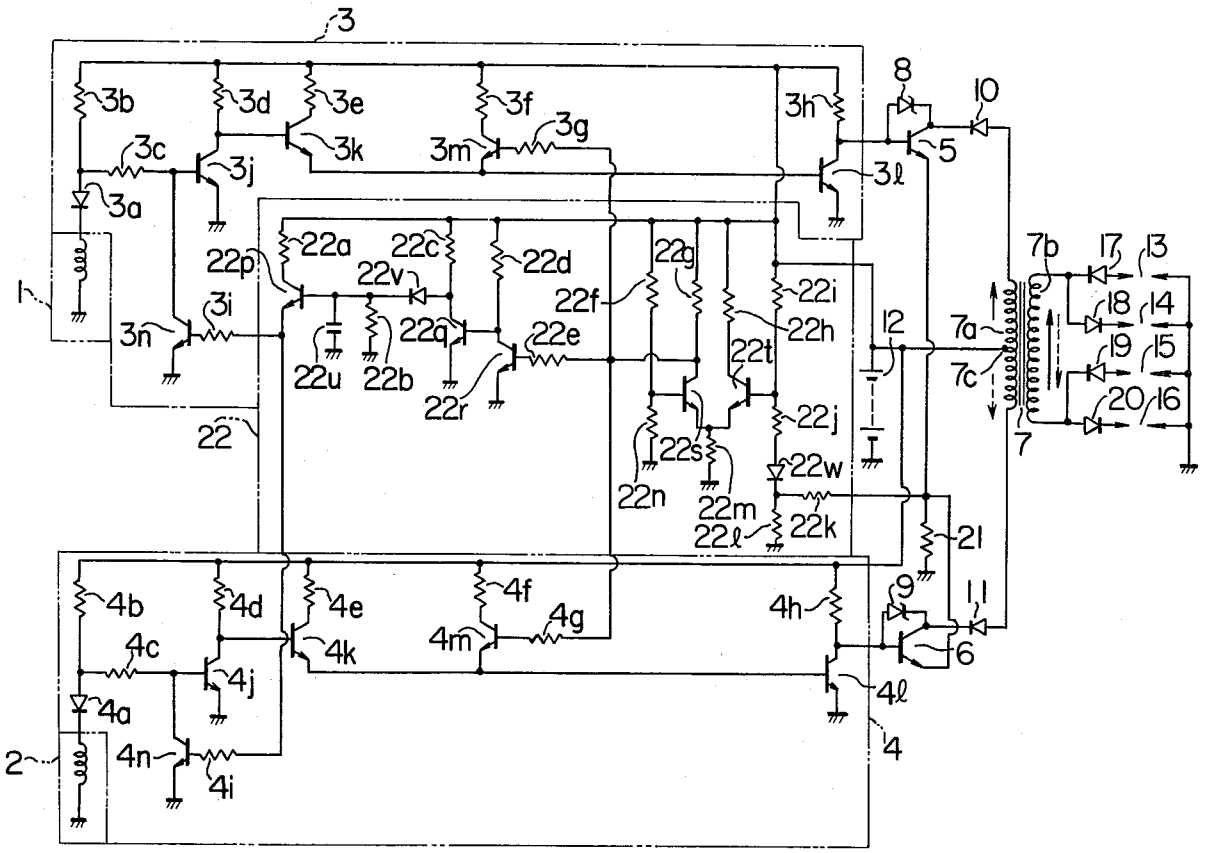
FIG. 1 is a circuit diagram showing a first embodiment of an ignition system according to the present invention.
Figure 2:
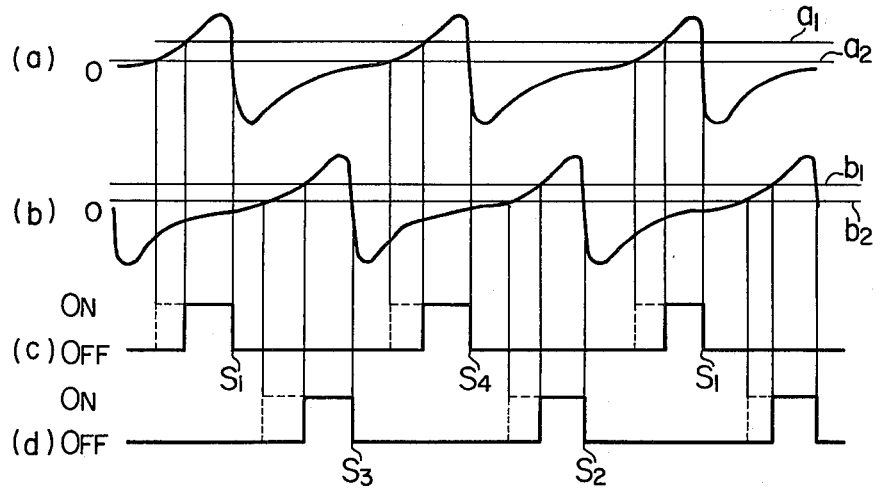
FIG. 2 shows a plurality of waveforms generated at the various points in FIG. 1, which are useful for explaining the operation of the embodiment of FIG. 1.

Referring first to FIG. 1 illustrating a first embodiment of the present invention, numerals 1 and 2 designate ignition signal generators adapted to respectively generate AC ignition signals as shown in (a) and (b) of FIG. 2 in synchronism with the rotation of an internal combustion engine. Numerals 3 and 4 designate waveform shaping circuits for respectively shaping the waveform of the ignition signals generated from the ignition signal generators 1 and 2 into rectangular waveform. As is well known in the art, in accordance, for example, with the intake negative pressure and the rotational speed of the engine the phases of the waveforms (a) and (b) in FIG. 2 (the crankshaft angular positions at which the signals are generated) are varied so as to vary the phases of the waveform shown in (c) and (d) of FIG. 2 and thereby to vary the ignition timing (the negative-going transition of the waveforms (c) and (d) in FIG. 2). Numerals 5 and 6 designate power transistors which are respectively turned on and off in response to the outputs of the waveform shaping circuits 3 and 4 so as to interrupt the primary current flow to an ignition coil 7. Numerals 8 and 9 designate Zener diodes for protecting the power transistors 5 and 6, 10 and 11 reverse current blocking diodes, 12 a power source, 13, 14, 15 and 16 spark plugs mounted into the respective cylinders of a four-cylinder engine, 17, 18, 19 and 20 high-tension diodes, and 21 a primary current detecting resistor for detecting the primary current flowing to the ignition coil 7, which is inserted and connected between the interconnected emitters of the power transistors 5 and 6 and the negative terminal or ground side of the power source 12. The ignition coil 7 comprises a primary widing **7*a* which is divided into two parts by a center terminal 7*c* and a secondary winding 7*b*. Numeral 22 designates a current control circuit for feedback controlling the primary current in accordance with the primary current detected by the primary current detecting resistor 21. The waveform shaping circuit 3 comprises a diode 3*a*, resistors 3*b* to 3*i*, an input transistor 3*j*, transistors 3*k* and 3*l*, a current controlling transistor 3*m* and a bias control transistor 3*n*. The waveform shaping circuit 4 comprises a diode 4*a*, resistors 4*b* to 4*i*, an input transistor 4*j*, transistors 4*k* and 4*l*, a current controlling transistor 4*m* and a bias control transistor 4*n*. The current control circuit 22 comprises resistors 22*a* to 22*n*, transistors 22*p* to 22*t*, a capacitor 22*u* and diodes 22*v* and 22*w***.

With the construction described above, the operation of the first embodiment is as follows. Assuming that the ignition signals generated from the ignition signal generators 1 and 2 as shown in (a) and (b) of FIG. 2, are respectively applied to the input transistors **3*j* and 4*j* and that the operating levels of the input transistors 3*j* and 4*j* are respectively at $a_1$ and $a_2$ shown in (a) and (b) of FIG. 2, the input transistors 3*j* and 4*j* are alternately turned on and off as shown by the solid lines in (c) and (d) of FIG. 2. The turn-on and turn-off actions of the input transistors 3*j* and 4*j* are respectively transmitted to the base of the power transistors 5 and 6 through the transistors 3*k* and 4*k* and the transistors 3*l* and 4*l*, so that the power transistors 5 and 6 are alternately turned on and off in the same phase with the input transistors 3*j* and 4*j* and the current flow in the primary winding 7*a* of the ignition coil 7 is switched on and off alternately in the solid and broken line directions on both sides of the center terminal 7*c* as shown in FIG. 1. On the other hand, when the power transistor 5 changes from the on-state to the off-state at $S_1$ and $S_4$, respectively, in FIG. 2, a high voltage is produced in the secondary winding 7*b* of the ignition coil 7 in the solid-line direction of FIG. 1 and the high voltage is applied to the spark plugs 14 and 15 through the diodes 18 and 19, respectively. Thus, as for example, at the point $S_1$ shown in FIG. 2, the ignition spark produced at the spark plug 14 explodes the mixture in the No. 1 cylinder, and at the point $S_4$ the mixture in the No. 4 cylinder is exploded by the ignition spark produced at the spark plug 15. When the other power transistor 6** is changed from the on-state to the off-state at the points $S_3$ and $S_2$ shown in FIG. 2, the resulting high voltage generated in the secondary winding 7*b* of the ignition coil 7 in the broken-line direction in FIG. 1 is applied to the spark plugs 13 and 16 through the diodes 17 and 20, respectively. Thus, as for example, at the point $S_3$ shown in FIG. 2 the mixture in the No. 3 cylinder is exploded by the ignition spark produced at the spark plug 13 and at the point $S_2$ the mixture in the No. 2 cylinder is exploded by the ignition spark produced at the spark plug 16.

On the other hand, when the power transistors 5 and 6 are turned on, respectively, current flows in the solid-line direction and the broken-line direction, respectively, of FIG. 1 and each of these currents flows through the primary current detecting resistor 21. Thus the terminal voltage of the resistor 21 assumes a value corresponding to the primary current value. When this primary current value exceeds a predetermined value, the transistor 22*t* is turned on and the transistor 22*s* is turned off. As a result, the current controlling transistors 3*m* and 4*m* are turned on so that the transistor 3*l* or 4*l* is turned on and the base current to the power transistor 5 or 6 is decreased. Thus, the power transistor 5 or 6 is operated in the unsaturation region so as to feedback control the primary current in the ignition coil 7 to a predetermined value. On the other hand, the turning off of the transistor 22*s* causes the transistor 22*r* to turn on so that the transistor 22*q* is turned off and the capacitor 22*u* is charged through the resistor 22*c* and the diode 22*v*. The stored charge on the capacitor 22*u* is always discharged through the resistor 22*b*. As a result, the terminal voltage of the capacitor 22*u* corresponds to the time interval during which the power transistor 5 and 6 operates in the unsaturation region. The terminal voltage of the capacitor 22*u* is amplified by the transistor 22*p* and then applied to the bias control transistors 3*n* and 4*n*, respectively, so as to change the operating level of the input transistors 3*j* and 4*j*, respectively. In this case, the terminal voltage of the capacitor 22*u* is increased with an increase in the time interval during which the power transistor 5 or 6 operates in the unsaturation region, so that the operating levels of the input transistors 3*j* and 4*j* are raised as shown for example at $a_1$ and $b_1$ in (a) and (b) of FIG. 2 and the conduction angle of the primary current in the ignition coil 7 is decreased. On the contrary, the terminal voltage of the capacitor 22*u* is decreased with a decrease in the time interval during which the power transistor 5 or 6 operates in the unsaturation region, so that the operating levels of the input transistors 3*j* and 4*j* are lowered as shown for example at $a_2$ and $b_2$ in (a) and (b) of FIG. 2 and the turn-on times of the input transistors 3*j* and 4*j* are advanced as shown by the broken lines in (c) and (d) of FIG. 2, thus increasing the primary current conduction angle of the ignition coil 7. In this way, the operation period of the power transistors 5 and 6 in the unsaturation region is feedback controlled to the proper value.

Figure 3:
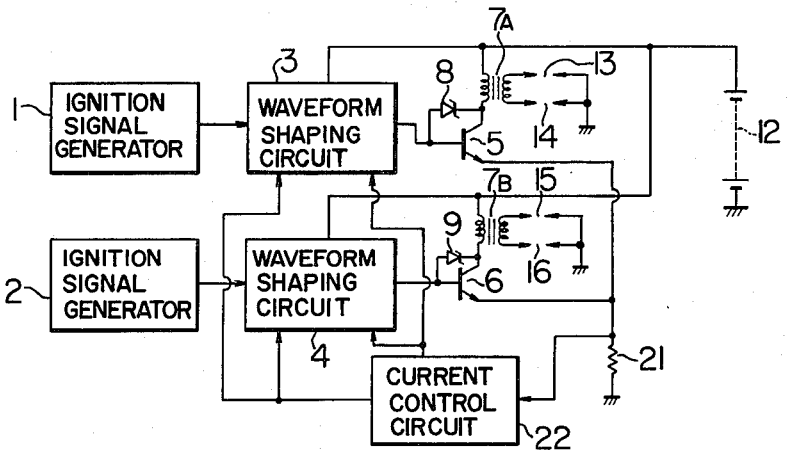
FIG. 3 is a circuit diagram showing a second embodiment of the ignition system according to the invention.

FIG. 3 illustrates a second embodiment of the present invention which differs from the first embodiment of FIG. 1 in that the ignition coil 7 and the high-tension diodes 17 to 20 are replaced with two ignition coils 7A and 7B which are respectively controlled by the power transistors 5 and 6 and that the spark plugs 13, 14 and 15, 16 are respectively connected to the secondary windings of the ignition coils 7A and 7B. Thus, the primary current flow in the ignition coils 7A and 7B are alternately switched on and off by the power transistors 5 and 6 so as to produce an ignition spark at the spark plugs 13 to 16.

With this type of ignition system including as many ignition coils as there are power transistors, by providing as many ignition circuits as corresponding to one half the number of cylinders each comprising an ignition signal generator, a waveform shaping circuit, a power transistor, a Zener diode and an ignition coil and by connecting two spark plugs to the secondary winding of each ignition coil, it is possible to apply the system to any engine having 2*n* cylinders, such as, six cylinders or eight cylinders. Where one spark plug is connected to the secondary winding of each ignition coil, by providing the same number of the ignition coils as the cylinders used, it is possible to apply the system to an engine having (n+1) cylinders such as two, three, four or five cylinders. In either of these cases, the required number of the primary current detecting resistor 21 and the current control circuit 22, respectively, is one.

Still further, in the case of an ignition system in which the four cylinders of an engine are caused to fire by a single ignition coil 7 as shown in FIG. 1, if two sets of elements including an ignition coil, a pair of power transistors for controlling the ignition coil, etc., are provided, the system may be used as an eight-cylinder engine ignition system. In this case, while two units, one for each set of the four cylinders, of the primary current detecting resistor 21 and the current control circuit 22, respectively, may be provided, it is possible to use one of each of them in common with the eight cylinders.

Further, while, in the above-described embodiments of the invention, the current control circuit 22 is designed so that both the primary current value and the primary current conduction angle are feedback controlled in accordance with the primary current detected by the primary current detecting resistor 21, the present invention may be applied to any system in which one or the other of the primary current value and the primary current conduction angle is feedback controlled.

It will thus be seen from the foregoing description that in accordance with the first and second embodiments of the present invention, by virtue of the fact that the emitters of a plurality of power transistors for interrupting the primary current in an ignition coil or coils are interconnected and that a primary current detecting resistor is connected between the interconnected emitters and one end of a power source and that a current control circuit is provided such that in accordance with the primary current detected by the primary current detecting resistor the power transistors are controlled so as to feedback control the primary current, there is a great advantage in that it is possible to use the current detecting resistor and the current control circuit in common with the plurality of power transistors, thus making it possible to simply the circuit construction and reduce the cost and also to reduce, by virtue of the common use of the circuit, the variation in primary current control caused by the differences between the power transistors.

We claim:

1. An ignition system for an internal combustion engine comprising:

an ignition coil including a primary winding divided into two parts by a center terminal connected to one end of a power source and a secondary winding;

a first pair of spark plugs connected in parallel with one end of said secondary winding of said ignition coil;

a second pair of spark plugs connected in parallel with the other end of said secondary winding;

a high-tension diode connected between each of said spark plugs and said ignition coil secondary winding with a polarity such that a positive-going output and a negative-going output generated in said secondary winding are distributed to said spark plugs;

a pair of power transistors having collectors thereof respectively connected to one and the other ends of said primary winding of said ignition coil and also having emitters thereof connected to each other;

a primary current detecting resistor connected between said interconnected emitters and the other end of said power source;

a current control circuit responsive to a primary current detected by said primary current detecting resistor to control said power transistors so as to feedback control said primary current; and ignition signal generating means for generating ignition signals so as to turn off said power transistors at different ignition times.

2. An ignition system for an internal combustion engine comprising:

a plurality of ignition coils each including a primary winding having one end thereof connected to one end of a power source and a secondary winding;

at least one spark plug connected to the secondary winding of each of said ignition coils;

a plurality of power transistors each having a collector thereof connected to the other end of the primary winding of corresponding ones of said ignition coils, said power transistors having emitters thereof connected to each other;

a primary current detecting resistor connected between said interconnected emitters of said power transistors and the other end of said power source;

ignition signal generating means for generating first and second ignition signals in synchronism with the rotation of said engine;

waveform shaping circuit means for transmitting said first and second ignition signals respectively to said plurality of power transistors; and a current control circuit responsive to a primary current detected by said primary current detecting resistor to control said power transistors through said waveform shaping circuit means to feedback control said primary current, said current control circuit providing a control signal to said waveform shaping circuit means.

3. An ignition system for an internal combustion engine comprising:

a plurality of ignition coils each including a primary winding having one end connected to one end of a power source and including a secondary winding connected to a spark plug;

a plurality of power transistors each having a collector connected to the other end of the primary winding of corresponding ones of said plurality of ignition coils, emitters of said power transistors being connected with each other;

a primary current detecting resistor connected to a junction point of said emitters of said power transistors to form a common current path for primary currents of said plurality of ignition coils;

a current control circuit connected to said primary current detecting resistor for producing a control signal representing the amount of a detected primary current;

first and second ignition signal generators for respectively generating first and second ignition signals having a predetermined time relationship therebetween;

a first waveform shaping circuit connected to said first ignition signal generator for converting said first ignition signal into a first on-off signal and for providing said first on-off signal to corresponding ones of said power transistors; and a second waveform shaping circuit connected to said second ignition signal generator for converting said second ignition signal into a second on-off signal and for providing said second on-off signal to corresponding ones of said power transistors;

said first and second waveform shaping circuits being further connected to said current control circuit to receive said control signal therefrom so that the amount of said first and second on-off signals is controlled in accordance with said control signal thereby providing feedback control for the amount of the primary current of each of said plurality of ignition coils.

4. An ignition system for an internal combustion engine comprising:

an ignition coil including a primary winding divided into two parts by a center terminal connected to one end of a power source and a secondary winding;

a first pair of spark plugs connected in parallel with one end of said secondary winding of said ignition coil;

a second pair of spark plugs connected in parallel with the other end of said secondary winding;

a high-tension diode connected between each of said spark plugs and said ignition coil secondary winding with a polarity such that a positive-going output and a negative-going output generated in said secondary winding are distributed to said spark plugs;

a pair of power transistors having collectors thereof respectively connected to one and the other ends of said primary winding of said ignition coil and also having emitters thereof connected to each other;

a primary current detecting resistor connected between said interconnected emitters and the other end of said power source;

ignition signal generating means for generating first and second ignition signals in synchronism with the rotation of said combustion engine;

waveform shaping circuit means for transmitting said first and second ignition signals respectively to said pair of power transistors; and a current control circuit responsive to a primary current detected by said primary current detecting resistor to control said power transistors through said waveform shaping circuit means so as to feedback control said primary current, said current control circuit providing a control signal to said waveform shaping circuit means.

* * * * *